United States Patent [19]

Brown

[11] 4,030,765

[45] June 21, 1977

[54] STORAGE DEVICE FOR SHARED GAME PIECES

[76] Inventor: John William Brown, 1847 W. Estes Ave., Chicago, Ill. 60626

[22] Filed: Feb. 18, 1976

[21] Appl. No.: 659,106

[52] U.S. Cl. ..... 273/148 R; 206/315 R; 273/137 R

[51] Int. Cl.[2] ..... A63F 3/00

[58] Field of Search ..... 273/148 R, 130 R, 136 K; 206/315

[56] References Cited

UNITED STATES PATENTS

| | | | |
|---|---|---|---|
| 834,301 | 10/1906 | Hollis | 273/148 R UX |
| 2,221,267 | 11/1940 | Robertson | 273/136 K |
| 2,230,699 | 2/1941 | Schultze | 273/148 R |
| 3,603,591 | 9/1971 | Shoptaugh | 273/130 R |

*Primary Examiner*—Anton O. Oechsle

*Attorney, Agent, or Firm*—Robert C. Lucke

[57] ABSTRACT

This invention is directed to an apparatus having a number of individual storage compartments for a plurality of game pieces. The pieces are used in a number of board games. Some pieces are unique to one game, and some pieces are common to two or more games. Selection of desired game pieces is obtained by placing a template, with discretely positioned holes cut therein, over the storage apparatus, blocking access to all compartments except those containing the desired pieces for the particular game. Those desired pieces can then be removed either manually or by turning the apparatus upside down allowing the pieces to fall out. The template is then left in place until the pieces are again ready for storage, thus facilitating the replacement of the pieces into their proper compartments in the storage apparatus.

1 Claim, 5 Drawing Figures

STORAGE DEVICE FOR SHARED GAME PIECES

FIELD OF THE INVENTION

This invention relates to structures used in the storage and retrieval of individual items, and more particularly, to the storage and retrieval of indicia bearing game pieces used as tokens on game boards.

SUMMARY OF THE INVENTION

Previously, such structures relied solely on markings placed near the apertures of the individual storage compartments to identify the pieces stored therein. Retrieval of the pieces was slow and cumbersome, as the location of each of the desired pieces had to be ascertained, each piece or set of pieces was manually extracted, and each compartment containing desired pieces was emptied separately from all other such compartments. Furthermore, upon replacement of the pieces into the storage apparatus, the location of the proper compartments had to again be ascertained, and often errors were made by returning pieces to wrong compartments.

My invention mitigates or eliminates all of the above mentioned problems by providing a specially prepared template for each set of pieces normally selected. The pieces of the desired set are then located by placing the proper template over the storage apparatus, thus blocking access to all pieces not desired. The desired pieces are then removed by turning the storage apparatus upside down, with template held in place, thus allowing the chosen pieces to fall out while preventing the fall of all other pieces. As an optional alternative, the pieces may be removed by hand, or with a grasping device such as tweezers, by merely allowing the template to act as a compartment selecting guide.

My invention also mitigates the problem of errors in the replacement of pieces into the storage apparatus by greatly reducing the number of accessable compartments.

My invention now makes practical the consolidation, into a common box, the pieces needed for a plurality of board games, particularly such games as chess. Chess has numerous national variations, each variation contributing an appreciable number of new and unique pieces.

My invention also provides, from an expanded use of the structure, a new and unique means for the teaching of set theory, as anyone conversant in the art will readily see.

OBJECTS OF THE INVENTION

As is apparent in the foregoing, it is an object of this invention to provide a means for storage and retrieval of game piece sets, for a plurality of board games, into a common storage apparatus.

It is another object of this invention to provide a means for storing, sorting and selectively dispensing a number of pieces into groups according to certain common piece attributes.

It is yet another object of this invention to provide an educational aid for the teaching of set theory.

The means for accomplishing the foregoing objects and other advantages, which will be apparent to those skilled in the art, are set forth in the following specification and claims, and are illustrated in the accompanying drawings.

BRIEF DESCRIPTION OF THE DRAWINGS

Reference is now made to the drawings in which.

DESCRIPTION OF A PREFERRED EMBODIMENT

Figure 1:
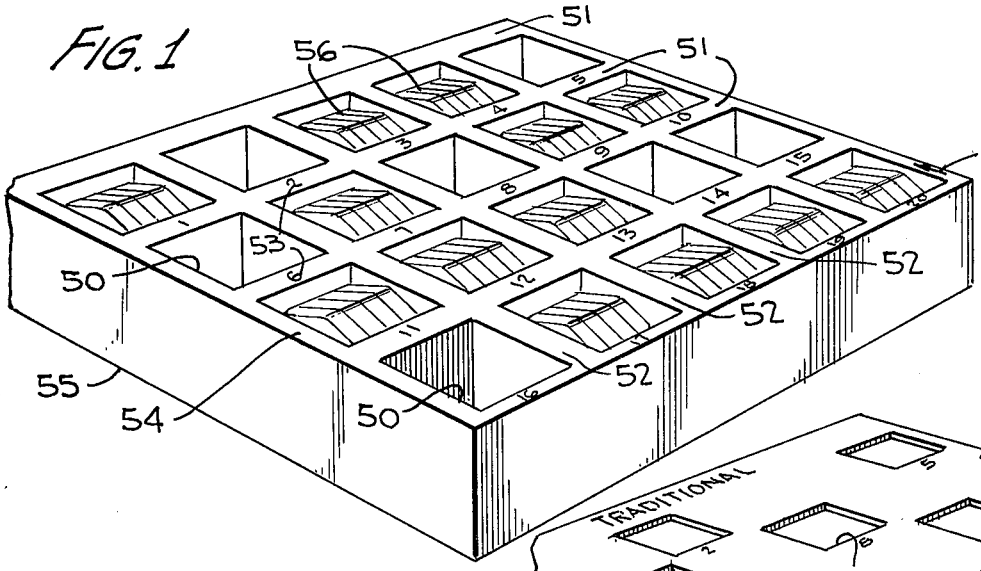
FIG. 1 is an isometric view of some of the indicia bearing means in place in the storage means.

Referring now to the drawings, illustrated in FIG. 1 is a storage apparatus of box like construction, having four rows and five columns of individual compartments 50 formed by the ninety degree intersection of five rows 51 and six columns 52 of vertical walls of equal height and equal thickness. The thickness of the walls is sufficient to bear a discernable notation 53 on the upper surface thereof. The compartments 50 are primarily cubical in shape, having five walls, the sixth and top wall being omitted to form an aperture for access to the piece means 56 stored therein. The compartment apertures all share the common plane defining the top 54 of the storage apparatus. The compartment bottoms all share the common rectangular wall forming the bottom 55 of the storage apparatus. The number, shape, and dimensionality of the storage compartments can be varied to fit the number and dimensions of the piece means 56 to be stored therein. One corner of the storage apparatus bears an alignment means 57 to facilitate alignment with the template means such as 58, 59 and 60. The alignment means 57 is shown in FIG. 1 as a printed arrow in the lower right hand corner of the top surface 54 of the storage apparatus. Other well known alignment means, such as a detent or pin system, can be positioned at any convenient location on said top surface without departing from the spirit of this invention.

The storage apparatus can be fabricated from wood or cardboard by well known techniques, or out of thermal plastic by vacuum forming or injection molding, or by other materials and techniques well known in the art.

Figure 2:
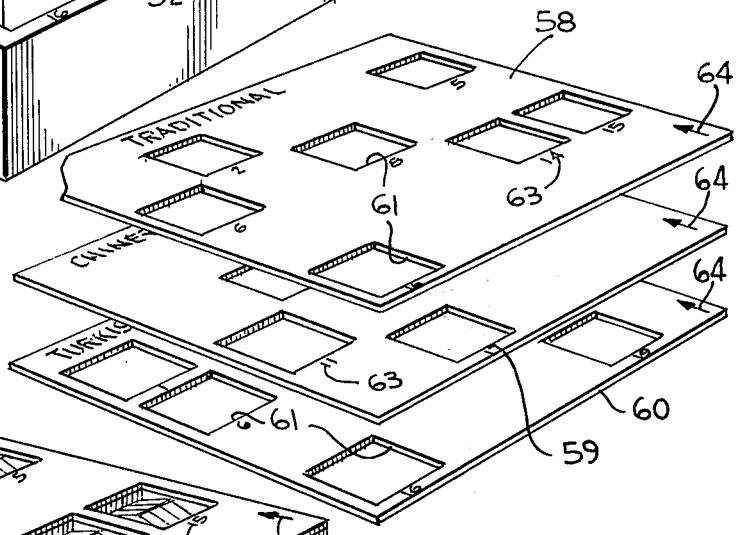
FIG. 2 is an isometric view of the template means showing apertures, a legend, and an alignment means.
Figure 3:
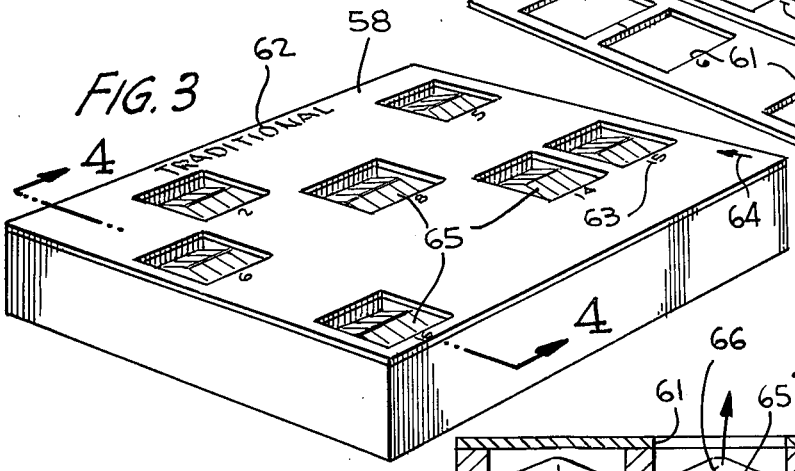
FIG. 3 is a view of a template means of FIG. 2 positioned on the storage means of FIG. 1.
Figure 4:
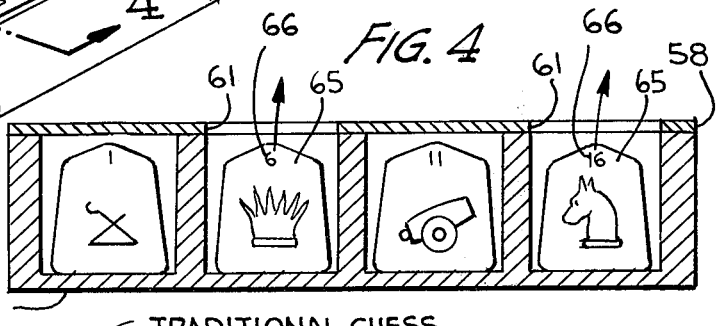
FIG. 4 is a cross sectional view of FIG. 3 as viewed along lines 4—4.

Referring now to FIG. 2 wherein is shown an example of three of the template means 58, 59 and 60 that can be used in this invention. The upper surface of topmost template 58 is completely visable and shows a matching rectangular shape of the top plane 54 of the storage apparatus of FIG. 1. The thickness of the template is dependent upon the structural requirements of the material utilized and can be appreciably thin. Shown on the template surface are means for providing square apertures 61, in this example, strategically placed to register with corresponding apertures of the storage apparatus when the template is placed in operative position on the top surface of the apparatus, as shown in FIGS. 3 and 4. Indicia on the template surface includes a legend 62 in the upper left hand corner and notations 63 positioned below each aperture identical to the notations 53 shown below the corresponding apertures of the storage device. Also shown on the template surface is a printed arrow 64 constituting an alignment means positioned to correspond to and key with the alignment means 57 on the top surface 54 of the storage apparatus as shown in FIG. 1. The number of templates 58, 59 and 60 provided, and the number and location of the template apertures 61 can be varied according to requirements introduced by the incorporation of differing sets of pieces as desired. The template means can most readily be formed by die cutting cardboard, thin plastic, or other thin scissle materials.

Referring now to FIG. 3 wherein is shown one of the template means 58 resting on the top surface 54 of the storage means. The template means 58 is positioned on top of the storage means in such a way that the edges, alignment means 64, and apertures 61 of the template means 58 register and align with the edges, alignment means 57, and chosen compartments of the storage means.

Referring now to FIG. 4 wherein is shown a cross-sectional view of a template means 58 resting on the top surface 54 of the storage means. The cross-section is taken at right angles across four of the storage compartments exposing the piece means 65 stored therein and showing the apertures 61 of the template means in registry with the apertures of the chosen storage compartments 50 of the storage means. It is apparent that access to and egress of the chosen stored piece means 65 is made possible and access to and egress of the stored piece means not chosen is prevented.

Figure 5:
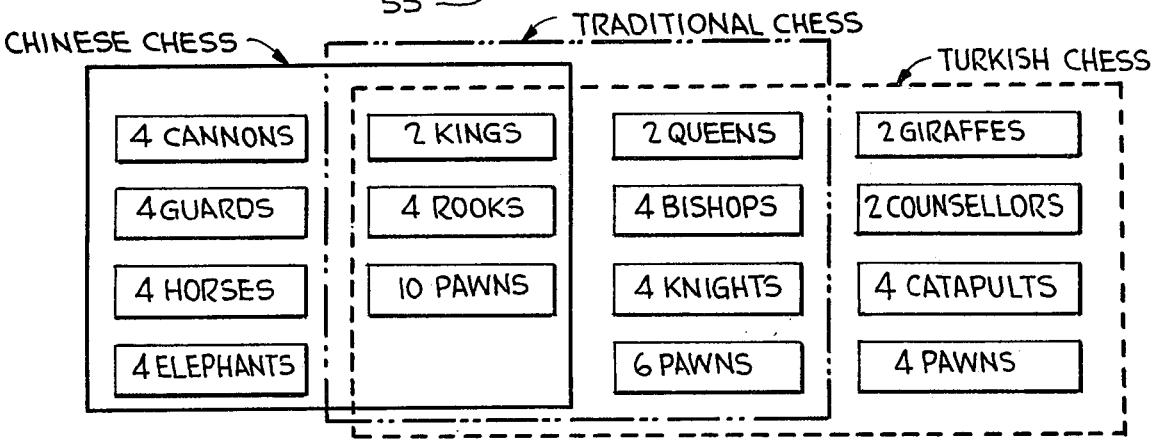
FIG. 5 is a symbolic representation of games pieces of three different games having some pieces in common.

Referring now to FIG. 5, the commonality of some of the pieces of three selected versions of chess are set forth. This diagram shows how the placement of apertures in a template is determined. It also teaches how the commonality of items in differing sets is utilized in this invention to eliminate duplicate items of sets and take advantage of minimum storage facilities for a maximum number of games or sets. In FIG. 5, it is seen that Chinese Chess requires four each of cannons, guards, horses, elephants, and rooks, two kings and ten pawns. Traditional Chess, the Chess commonly played in the United States, requires two kings, four rooks, and ten pawns, some of the same pieces as found in Chinese Chess. The template for Chinese Chess would include aperture means to cover compartments containing the set of unique pieces as well as additional aperture means to cover other compartments containing the same pieces common with Traditional Chess. The template for Traditional Chess will have these same said additional aperture means plus aperture means for compartments in which are stored two queens, four bishops, four knights, and six additional pawns. Turkish Chess templates would have aperture means aligned with all of the compartments containing Traditional Chess pieces plus aperture means for the two giraffes, two counsellors, four catapults and four additional pawns.

It is seen that any plurality of games or sets may be provided with the number of compartments and templates readily adapted to the requirements of such provision within the teachings of this invention.

OPERATION OF THE DEVICE

The proper template is chosen by reference to the legend 62 thereon describing the desired common attributes of the pieces to be extracted. The chosen template, such as 58, is then positioned over the top of the storage apparatus, as shown in FIG. 3, care being taken to properly align the edges and to have the alignment means 64 of the template keyed to the alignment means 57 of the storage apparatus.

The desired pieces 65 are then retrieved by hand, or with grasping devices, removing all pieces 65 available through apertures 61 of both template and storage apparatus, or by turning the storage apparatus upside down, with template 58 held in place, allowing the desired pieces 65 to fall out.

The template 58 is then left in place until such time as it is desired to return the pieces 65 to the storage apparatus. Replacement of the pieces 65 into their proper storage compartments is then achieved by dropping each piece through the template aperture 61 bearing the notation 63 corresponding to a keying notation 66 shown by the piece.

From the foregoing, it is shown that my invention has many advantages over the prior art. It now makes possible a quick and efficient selection of incorporated sets of items, including some items that are included in more than one set. As illustrated in FIG. 5, 32 pieces are used in Traditional Chess, 32 pieces are used in Chinese Chess, and 44 pieces are used in Turkish Chess. The combined number of pieces for the three illustrated chess games is 108. However, only 60 pieces need be stored in my apparatus, since 48 of the pieces are eliminated by sharing common pieces among the plurality of sets.

From the foregoing example, one can immediately see the practical and economic advantages that my invention affords. Furthermore, it is readily apparent that the structure is a teaching aid and a tangible expression of principles of set theory.

In as much as many changes could be made in the above constructions, and many apparently widely different embodiments of my invention could be made without departing from the scope thereof, it is intended that all matter contained in the above description or shown in the accompanying drawing shall be interpreted as illustrative and not in a limiting sense.

It is also to be understood that the language contained in the following claims is intended to cover all the generic and specific features of the invention herein described and all statements of the scope of the invention which, as a matter of language, might be said to fall therebetween.

What is claimed is:

1. In combination, means for providing a plurality of storage compartments, each of said compartments having an access means therein, a plurality of playing pieces for a plurality of varieties of chess games, and a plurality of templates having different aperture arrays, each of said templates cooperating with said access means to provide access to a different plurality of compartments, each of said different plurality of compartments containing the pieces for a different chess game.

* * * * *